US011761327B2

(12) United States Patent
Merino et al.

(10) Patent No.: US 11,761,327 B2
(45) Date of Patent: Sep. 19, 2023

(54) DEPTH POSITIONING USING GAMMA-RAY CORRELATION AND DOWNHOLE PARAMETER DIFFERENTIAL

(71) Applicant: Schlumberger Technology Corporation, Sugar Land, TX (US)

(72) Inventors: Carlos Merino, Clamart (FR); Fadhel Rezgui, Clamart (FR)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 16/530,621

(22) Filed: Aug. 2, 2019

(65) Prior Publication Data

US 2019/0390543 A1 Dec. 26, 2019

Related U.S. Application Data

(63) Continuation of application No. 15/324,402, filed as application No. PCT/EP2015/001409 on Jul. 9, 2015, now abandoned.

(Continued)

(30) Foreign Application Priority Data

Jul. 10, 2014 (EP) ..... 14290206

(51) Int. Cl.
*E21B 47/053* (2012.01)
*E21B 47/09* (2012.01)
(Continued)

(52) U.S. Cl.
CPC ..... *E21B 47/053* (2020.05); *E21B 47/09* (2013.01); *E21B 47/12* (2013.01); *E21B 49/00* (2013.01); *E21B 47/06* (2013.01); *E21B 47/07* (2020.05)

(58) Field of Classification Search
CPC ..... E21B 47/044; E21B 43/119; E21B 47/09; E21B 47/12; E21B 49/00
See application file for complete search history.

(56) References Cited

U.S. PATENT DOCUMENTS 3,291,208 A 12/1966 Kenneday
3,426,204 A 2/1969 Sutton
(Continued)

FOREIGN PATENT DOCUMENTS

CN 204253013 U 4/2015
EP 0633391 A2 1/1995
(Continued)

OTHER PUBLICATIONS

International Search Report and Written Opinion issued in the related PCT Application PCT/EP2015/001409 dated Nov. 2, 2015 (13 pages).

(Continued)

*Primary Examiner* — Theodore N Yao
(74) *Attorney, Agent, or Firm* — Jeffrey D. Frantz

(57) ABSTRACT

Methods, systems, and apparatuses for determining the location or depth in a wellbore of a tubular string or downhole component is provided. One method may include placing a tubular string having a depth measurement module into a wellbore, the wellbore emanating radiation at at least one location along the wellbore and determining the location of the depth measurement module in the wellbore based on a correlation between a wellbore property that is a function of depth and a radiation intensity at at least one location within the wellbore.

13 Claims, 5 Drawing Sheets

Related U.S. Application Data

(60) Provisional application No. 62/188,457, filed on Jul. 2, 2015.

(51) Int. Cl.

| | |
|---|---|
| ***E21B 47/12*** | (2012.01) |
| ***E21B 49/00*** | (2006.01) |
| ***E21B 47/07*** | (2012.01) |
| ***E21B 47/06*** | (2012.01) |

(56) References Cited

U.S. PATENT DOCUMENTS

| | | | | |
|---|---|---|---|---|
| 5,279,366 | A * | 1/1994 | Scholes | E21B 43/119 166/254.2 |
| 5,285,065 | A | 2/1994 | Daigle et al. | |
| 5,469,916 | A | 11/1995 | Sas-Jaworsky et al. | |
| 5,896,939 | A | 4/1999 | Witte | |
| 6,516,663 | B2 | 2/2003 | Wong | |
| 7,770,639 | B1 | 8/2010 | Pledger | |
| 8,016,036 | B2 | 9/2011 | Kirkwood et al. | |
| 8,122,954 | B2 | 2/2012 | Estes et al. | |
| 8,528,637 | B2 * | 9/2013 | Cresswell | E21B 47/04 166/255.1 |
| 2004/0222019 | A1 | 11/2004 | Estes et al. | |
| 2005/0199392 | A1 * | 9/2005 | Connell | E21B 47/053 166/254.2 |
| 2008/0033704 | A1 | 2/2008 | Sayers et al. | |
| 2008/0035335 | A1 | 2/2008 | Newman | |
| 2008/0257546 | A1 * | 10/2008 | Cresswell | E21B 47/04 166/250.15 |
| 2011/0191027 | A1 * | 8/2011 | Pfutzner | E21B 47/10 702/6 |
| 2012/0230151 | A1 | 9/2012 | Almaguer | |
| 2013/0008646 | A1 | 1/2013 | Blount | |
| 2013/0008650 | A1 | 1/2013 | Blount | |
| 2013/0153212 | A1 | 6/2013 | Myers | |
| 2014/0374164 | A1 | 12/2014 | Benson et al. | |
| 2016/0131792 | A1 * | 5/2016 | Benson | G01V 5/045 702/6 |
| 2017/0159423 | A1 | 6/2017 | Merino et al. | |
| 2017/0176180 | A1 | 6/2017 | Merino et al. | |
| 2018/0291725 | A1 | 10/2018 | Kyle | |

FOREIGN PATENT DOCUMENTS

| | | | |
|---|---|---|---|
| EP | 2966258 | A1 | 1/2016 |
| GB | 2354026 | A | 3/2001 |

OTHER PUBLICATIONS

Extended Search Report issued in the related EP Application 14290206.3 dated Dec. 23, 2014 (7 pages).

Extended Search Report issued in the related EP Application 15290327.4 dated May 30, 2016 (7 pages).

International Preliminary Report on patentability issued in the related PCT Application PCT/EP2015/001409, dated Jan. 10, 2017 (8 pages).

Coope, D.F. (Jan. 1, 1983), Gamma Ray Measurement-While-Drilling, Society of Petrophysicists and Well-Log Analysts, https://www.onepetro.org/journal-paper/SPWLA-1983-vXXIVn1a1 (7 pages).

Office Action issued in the related U.S. Appl. No. 15/324,402, dated May 30, 2018 (10 pages).

Office Action issued in the related U.S. Appl. No. 15/324,402, dated Nov. 16, 2018 (30 pages).

Doll, H. G., & Schwede, H. F. (Dec. 1, 1948). Radioactive Markers in Oil-field Practice. Society of Petroleum Engineers (10 pages).

Office Action issued in the related U.S. Appl. No. 15/369,942, dated Mar. 7, 2019 (25 pages).

Office Action issued in the related U.S. Appl. No. 15/324,402, dated Apr. 2, 2019 (18 pages).

* cited by examiner

DEPTH POSITIONING USING GAMMA-RAY CORRELATION AND DOWNHOLE PARAMETER DIFFERENTIAL

CROSS-REFERENCE TO RELATED APPLICATIONS

This application is a continuation of U.S. patent application Ser. No. 15/324,402 filed Jan. 6, 2017, which is a National Phase filing of PCT Application No. PCT/EP2015/001409 filed Jul. 9, 2015 which claims priority to European Patent Application No. 14290206.3 filed Jul. 10, 2014 and U.S. Provisional Application Ser. No. 62/188,457 filed Jul. 2, 2015, which are herein incorporated by reference.

BACKGROUND

This disclosure relates to placement of a tubular string, such as a drill string or a tubing string, downhole in a wellbore, and more particularly to methods and apparatuses for placing downhole tools and tubular strings at a desired depth and location in a wellbore.

DESCRIPTION OF THE RELATED ART

One of the more difficult problems associated with any borehole system is to know the relative position and/or location of a tubular string in relation to the formation or any other reference point downhole. For example, in the oil and gas industry it is sometimes desirable to place systems at a specific position in a wellbore during various drilling and production operations such as drilling, perforating, fracturing, drill stem or well testing, reservoir evaluation testing, and pressure and temperature monitoring.

Typically, in order to determine the depth or location of a tool located on a tubular string in a wellbore, the number of tubulars, such as pipe, tubing, collars, jars, etc., is counted as the tubulars are lowered into the wellbore. The depth or location of the drillstring or a downhole tool along the drillstring will then be based on the number of components lowered into the wellbore and the length of those components, such as the length of the individual drill pipes, collars, jars, tool components, etc. However, as a tubular string increases length as more components are run in hole (RIH), e.g. at a string length of ca. 10,000 ft. or longer, the tubular string often lacks stiffness and rigidity, and may become somewhat elastic and flexible. Thus, when conveying the tubular string into the wellbore, improper or inaccurate measurements of the length, depth, and location of the tubular string may take place due to inconsistent lengths of individual components such as drill pipes, tubing, or other downhole components, stretching of pipe and tubing components, wellbore deviations, or other inaccuracies, resulting in improper placement of the tubular string and associated downhole tools used for various operations.

Therefore, there is a need to more accurately place and determine the location of downhole tools and strings in a wellbore.

SUMMARY

In some embodiments, methods, systems, and apparatuses for determining the location or depth in a wellbore of a tubular string or downhole component is provided. In some embodiments, a method includes placing a tubular string having a depth measurement module into a wellbore, the wellbore emanating radiation at at least one location along the wellbore and determining the location of the depth measurement module in the wellbore based on a correlation between a wellbore property that is a function of depth and a radiation intensity at at least one location within the wellbore.

In some embodiments, a method includes placing a tubular string having a depth measurement module into a wellbore having a radioactive pip-tag. The method includes measuring a first distance, $h_1$, from a rig floor to a top of the tubular string when the depth measurement module is at a first location in the wellbore above the pip-tag and measuring a wellbore property at the first location, $DP_{start}$, using the depth measurement module. The method also includes connecting at least one if not more tubulars of known length L to the tubular string, lowering the tubular string into the wellbore, and measuring the wellbore property at a second location when the depth measurement module is at the radioactive pip-tag, $DP_{pip}$. The method also includes measuring the wellbore property at a third location in the wellbore below the pip-tag, $DP_{end}$, and measuring a second distance, $h_2$, from the rig floor to the top of the tubular string when the tubular string is at the third location. The method also includes determining the location of the depth measurement module in the wellbore based on a correlation of $h_1$, $h_2$, L, and the measured wellbore properties at the first, second, and third locations, $DP_{start}$, $DP_{pip}$, and $DP_{end}$.

In some embodiments, an apparatus includes a tubular string having a depth measurement module. The depth measurement module includes a telemetry device, a wellbore property sensor and a radiation sensor. The sensed wellbore property is a function of depth.

In some embodiments, a system for determining the position of a downhole tubular string in a wellbore includes a tubular string disposed in the wellbore. The tubular string has a depth measurement module. The depth measurement module includes a telemetry device, a wellbore property sensor, and a radiation sensor. The sensed wellbore property is a function of depth. The system also includes a radioactive source disposed at a location along the wellbore, and a telemetry system for communication between the depth measurement module and a wellbore surface system.

BRIEF DESCRIPTION OF THE DRAWINGS

So that the manner in which the above recited features can be understood in detail, a more particular description may be had by reference to embodiments, some of which are illustrated in the appended drawings, wherein like reference numerals denote like elements. It is to be noted, however, that the appended drawings illustrate various embodiments and are therefore not to be considered limiting of its scope, and may admit to other equally effective embodiments.

DETAILED DESCRIPTION

Figure 1:
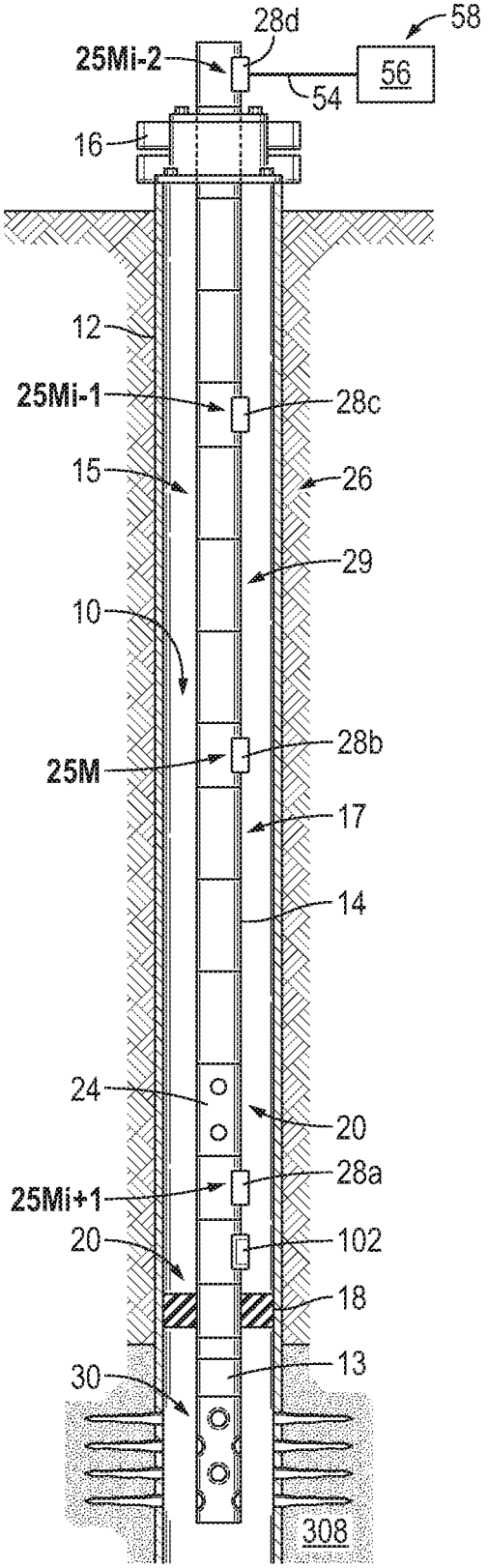
FIG. 1 shows a schematic view of a tubular string having an acoustic telemetry system utilized in some embodiments described herein.

In the following description, numerous details are set forth to provide an understanding of the present disclosure. It will be understood by those skilled in the art, however, that the embodiments of the present disclosure may be practiced without these details and that numerous variations or modifications from the described embodiments may be possible.

In the specification and appended claims: the terms "connect", "connection", "connected", "in connection with", and "connecting" are used to mean "in direct connection with" or "in connection with via one or more elements"; and the term "set" is used to mean "one element" or "more than one element". Further, the terms "couple", "coupling", "coupled", "coupled together", and "coupled with" are used to mean "directly coupled together" or "coupled together via one or more elements". As used herein, the terms "up" and "down", "upper" and "lower", "upwardly" and downwardly", "upstream" and "downstream"; "above" and "below"; and other like terms indicating relative positions above or below a given point or element are used in this description to more clearly describe some embodiments of the disclosure.

Embodiments generally described herein include systems, devices, and methods of determining the location of a tubular string in a wellbore, and positioning the tubular string at a desired location within the wellbore. Some embodiments may include a telemetry system for communicating information and transmitting control signals between the surface and downhole components along the tubular string. Some examples of telemetry systems that may be used include, but are not limited to, electrical cable systems such as wired drill pipe, fiber optic telemetry systems, and wireless telemetry systems using acoustic and/or electromagnetic signals. The telemetry systems may deliver status information and sensory data to the surface, and control downhole tools directly from the surface in real time or near real time conditions.

Although multiple types of telemetry systems may be used in embodiments of the disclosure, to simplify the discussion of some embodiments reference will be made to a wireless telemetry system, such as the acoustic telemetry system shown in FIG. 1. Additionally, it should be noted that multiple types of strings and components used to make up tubular strings may be used in embodiments of the disclosure. For example, drilling components may be used to make up a drill string. Some drilling components may include drill pipe, collars, jars, downhole tools, etc. Production strings may generally include tubing and various tools for testing or production such as valves, packers, and perforating guns, etc. As used herein, the term tubular string includes any type of tubular such as drilling or production pipes, tubing, components, and tools used in a tubular string for downhole use, such as those previously described. Thus, a tubular string includes, but is not limited to, drill strings, tubing strings, production strings, drill stem testing (DST) strings, and any other string in which various types of tubing and/or tubing type tools are connected together to form the tubular string.

Embodiments described herein may be used during any oil and gas exploration, characterization, or production procedure in which it is desirable to know and position the location of the tubular string and/or a downhole component that is a part of the tubular string within the wellbore. For example, embodiments disclosed herein may be applicable to testing wellbores such as are used in oil and gas wells or the like. FIG. 1 shows a schematic view of a tubular string equipped for well testing and having an acoustic telemetry system according to embodiments disclosed herein. Once a wellbore 10 has been drilled through a formation, the tubing string 15 can be used to perform tests, and determine various properties of the formation through which the wellbore has been drilled.

In the example of FIG. 1, the wellbore 10 has been lined with a steel casing 12 (cased hole) in the conventional manner, although similar systems can be used in unlined (open hole) environments. In order to test the formations, it is desirable to place a testing apparatus 13 in the well close to regions to be tested, to be able to isolate sections or intervals of the well, and to convey fluids from the regions of interest to the surface. This is commonly done using tubular members 14, such as drill pipe, production tubing, or the like (collectively, tubing 14), that, when joined form a drill string or tubing string 15 which extends from well-head equipment 16 at the surface (or sea bed in subsea environments) down inside the wellbore 10 to a zone of interest 308. The well-head equipment 16 can include blow-out preventers and connections for fluid, power and data communication.

A packer 18 is positioned on the tubing 14 and can be actuated to seal the borehole around the tubing 14 at the zone of interest 308. Various pieces of downhole equipment 20 are connected to the tubing 14 above or below the packer 18. The downhole equipment 20 may include, but is not limited to: additional packers, tester valves, circulation valves, downhole chokes, firing heads, TCP (tubing conveyed perforator), gun drop subs, samplers, pressure gauges, downhole flow meters, downhole fluid analyzers, and the like.

In the embodiment shown in FIG. 1, a tester valve 24 is located above the packer 18, and the testing apparatus 13 is located below the packer 18. The testing apparatus 13 could also be placed above the packer 18 if desired. In order to support signal transmission along the tubing 14 between the downhole location and the surface, a series of wireless modems 25$M_{i-2}$, 25$M_{i+1}$, 25M, 25$M_{i+1}$, etc. may be positioned along the tubular string 15 and mounted to the tubing 14 via any suitable technology, such as gauge carriers 28*a*, 28*b*, 28*c*, 28*d*, etc. to form a telemetry system 26. The tester valve 24 is connected to acoustic modem 25Mi+1. Gauge carrier 28*a* may also be placed adjacent to tester valve 24, with a pressure gauge also being associated with each wireless modem. As will be described in more detail below, the tubular string 15 may also include a depth measurement module 102 for determining the location of the tubular string 15 within the wellbore 10 and to position tools along the tubular string at desired locations, such as a perforating gun 30 in a zone of interest 308.

The wireless modems 25$M_{i-2}$, 25$M_{i-1}$, 25M, 25$M_{i+1}$ can be of various types and communicate with each other via at least one communication channel 29 using one or more various protocols. For example, the wireless modems 25$M_{i-2}$, 25$M_{i-1}$, 25M, 25$M_{i+1}$ can be acoustic modems, i.e., electro-mechanical devices adapted to convert one type of energy or physical attribute to another, and may also transmit and receive, thereby allowing electrical signals received from downhole equipment 20 to be converted into acoustic signals for transmission to the surface, or for transmission to other locations of the tubular string 15. In this example, the communication channel 29 is formed by the elastic media 17 such as the tubing 14 connected together to form tubular string 15. It should be understood that the communication channel 29 can take other forms. In addition, the wireless modem 25Mi+1 may operate to convert acoustic tool control signals from the surface into electrical signals for operating the downhole equipment 20. The term "data," as used herein, is meant to encompass control signals, tool status signals, sensory data signals, and any variation thereof whether transmitted via digital or analog signals. Other appropriate tubular member(s) (e.g., elastic media 17) may be used as the communication channel 29, such as production tubing, and/or casing to convey the acoustic signals.

Wireless modems 25Mi+(2-10) and 25Mi+1 operate to allow electrical signals from the tester valve 24, the gauge carrier 28*a*, and the testing apparatus 13 to be converted into wireless signals, such as acoustic signals, for transmission to the surface via the tubing 14, and to convert wireless acoustic tool control signals from the surface into electrical signals for operating the tester valve 24 and the testing apparatus 13. The wireless modems can be configured as repeaters of the wireless acoustic signals. The modems can operate to transmit acoustic data signals from sensors in the downhole equipment 20 along the tubing 14. In this case, the electrical signals from the downhole equipment 20 are transmitted to the acoustic modems which operate to generate an acoustic signal. The modem 25Mi+2 can also operate to receive acoustic control signals to be applied to the testing apparatus 13. In this case, the acoustic signals are demodulated by the modem, which operates to generate an electric control signal that can be applied to the testing apparatus 13.

As shown in FIG. 1, in order to support acoustic signal transmission along the tubing 14 between the downhole location and the surface, a series of the acoustic modems 25Mi−1 and 25M, etc. may be positioned along the tubing 14. The acoustic modem 25M, for example, operates to receive an acoustic signal generated in the tubing 14 by the modem 25Mi−1 and to amplify and retransmit the signal for further propagation along the tubing 14. Thus an acoustic signal can be passed between the surface and the downhole location in a series of short and/or long hops.

The acoustic wireless signals, conveying commands or messages, propagate in the transmission medium (the tubing 14) in an omni-directional fashion, that is to say up and down the tubing string 15. A wellbore surface system 58 is provided for communicating between the surface and various tools downhole. The wellbore surface system 58 may include a surface acoustic modem 25Mi−2 that is provided at the head equipment 16, which provides a connection between the tubing string 15 and a data cable or wireless connection 54 to a control system 56 that can receive data from the downhole equipment 20 and provide control signals for its operation.

Figure 2:
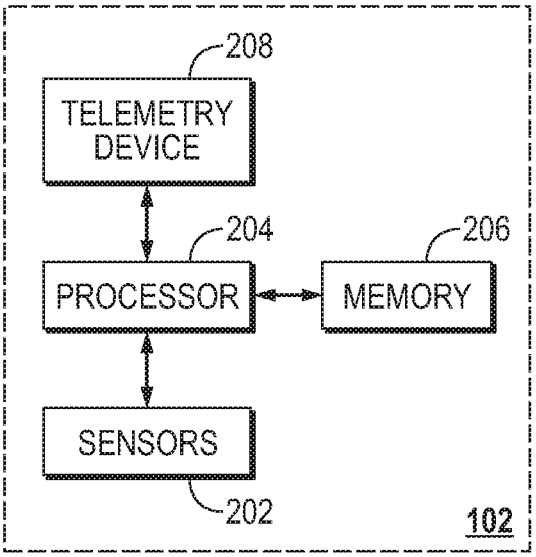
FIG. 2 shows a schematic diagram of a depth measurement module that is a part of the tubular string shown in FIG. 1.

FIG. 2 is a schematic diagram of a depth measurement module 102. In some embodiments, the depth measurement module 102 may be configured to include a telemetry device 208 having a transmitter and receiver for sending and/or receiving status requests and sensory data, triggering commands, and synchronization data. The depth measurement module 102 may also include one or more sensors 202 coupled to at least one processor 204. More than one processor 204 may also be used. The processor 204 may be coupled to the telemetry device 208 and to a memory device 206 for storing sensor data, parameters, and the like. The sensors 202 may include radiation sensors and any type of downhole parameter or wellbore property sensor, where the downhole parameter or wellbore property is a function of depth. Examples of some sensors include, but are not limited to, temperature based sensors, pressure based sensors, gamma-ray sensors, gravity sensors, density sensors, and accelerometers.

Figure 3:
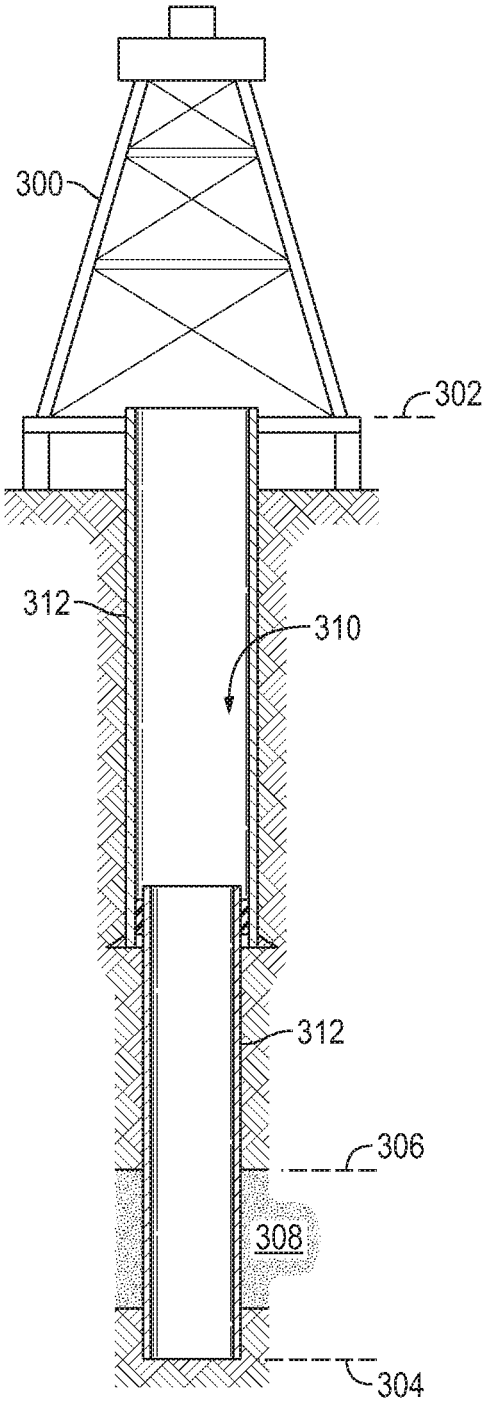
FIG. 3 is a schematic view of a wellbore and a surface rig above the wellbore.

FIG. 3 shows a schematic view of another wellbore 310, similar to the wellbore 10 shown in FIG. 1, and having casing 312. A rig 300 having a rig floor 302 is positioned above the wellbore 310. A known zone of interest 308 is located at a certain depth below the surface. The zone of interest 308 may include various types of hydrocarbons, such as oil and/or gas. The wellbore has a total depth (TD) 304. A shooting depth (SD) 306 is located at the beginning of the zone of interest 308. In some testing and/or production operations, a perforating gun is positioned next to the zone of interest 308 in order to fire the gun into the zone of interest 308, and begin a well test or production, as previously shown in FIG. 1. In some applications, the wellbore 310 may be a non-vertical wellbore.

Ascertaining the position of the gun downhole may be difficult, resulting in potential misfiring of the gun in a sub-optimal location within the wellbore. It should be noted that positioning a perforating gun at a desired location within a wellbore is but one example of an operation where the location of the tubular string or a downhole tool is desirable for performing the operation. Other examples of well operations where accurate placement of a tubing string and/or downhole tools within a wellbore include but are not limited to well operations such as placement of a packer assembly at a desired location along the wellbore 310 and placement of pressure and temperature sensors in a wellbore, such as may be done during well testing. As other types of operations may involve knowing the location of the tubing string or a downhole tool, FIGS. 4A and 4*b* simply shows a tubing string 315 having a depth measurement module 120 without any other downhole tools that could also form a portion of the tubular string 315 such as was previously shown in FIG. 1.

Figure 4A:
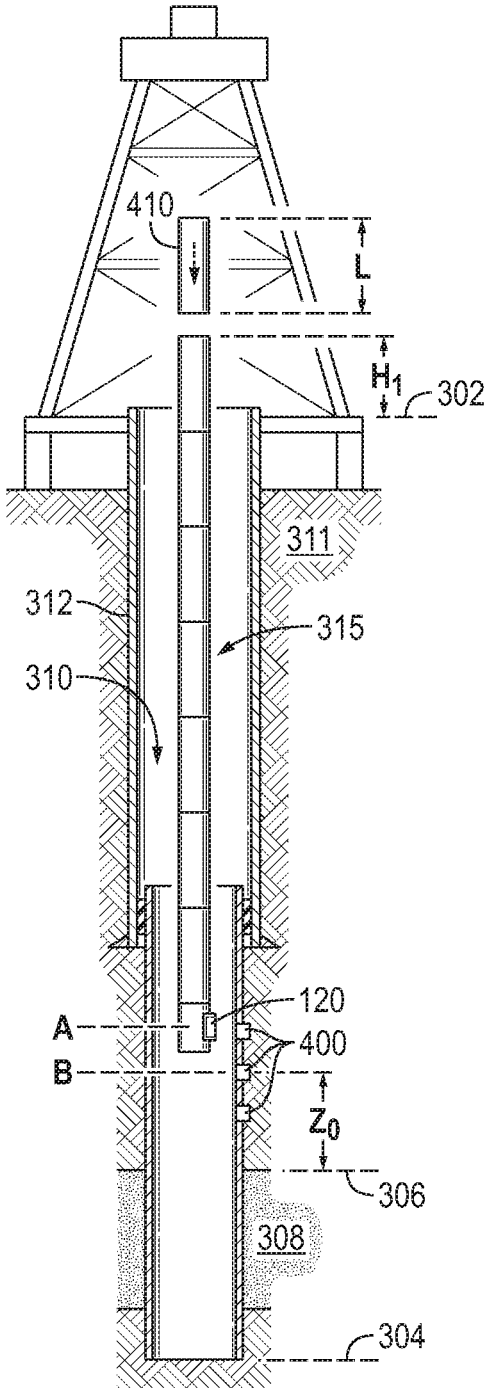
FIG. 4A is a schematic view of a tubular string in a wellbore according to some embodiments of the present disclosure.
Figure 4B:
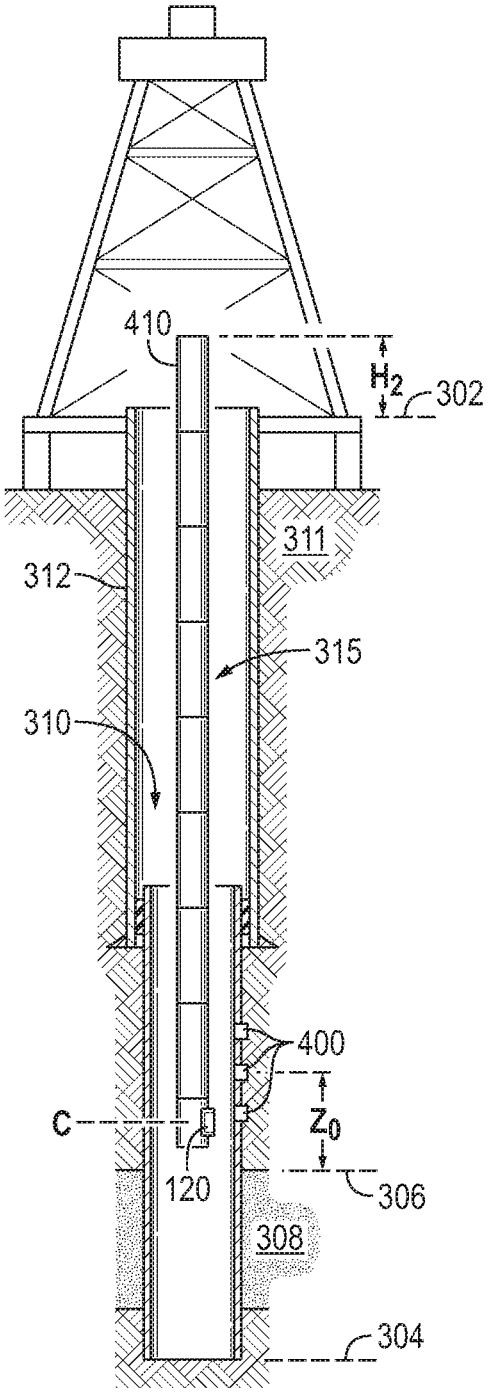
FIG. 4B is schematic view of a tubular string lowered in a wellbore according to some embodiments of the present disclosure.
Figure 5:
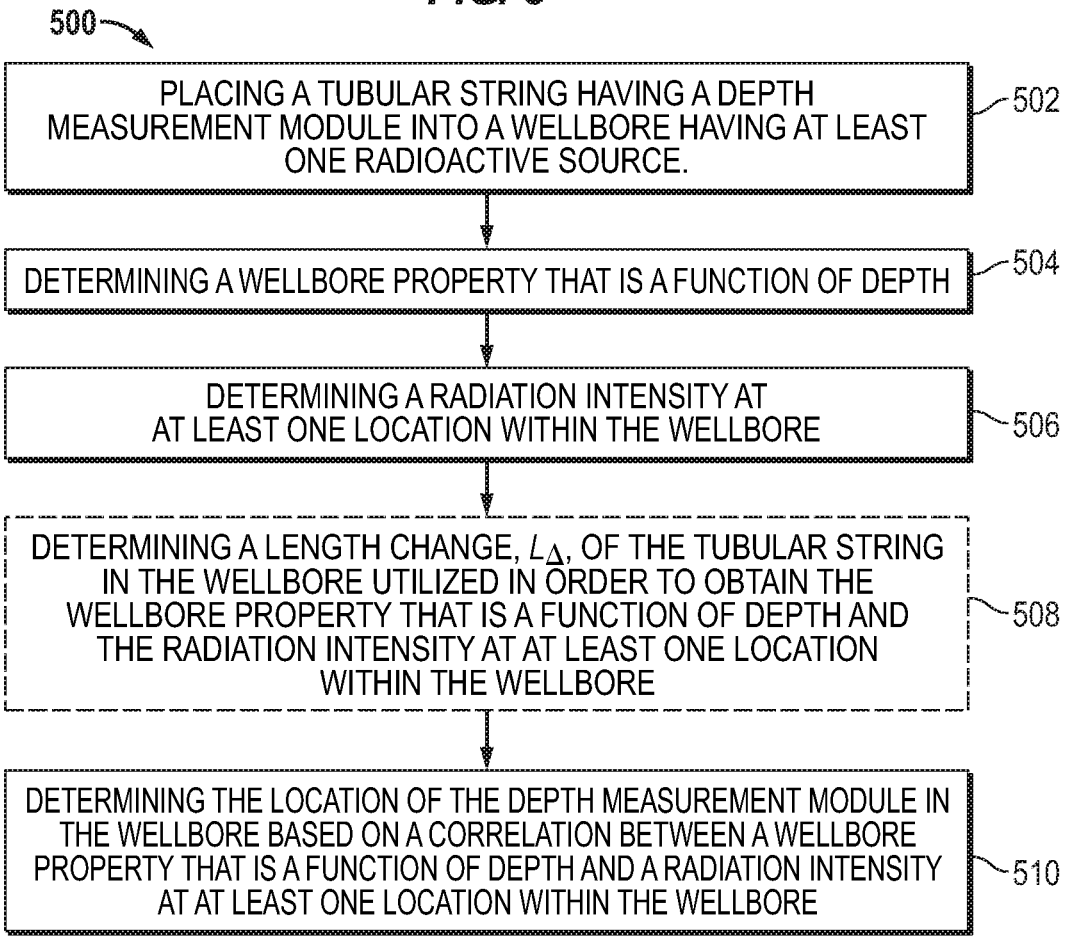
FIG. 5 is a flow diagram illustrating a method of determining the position of a downhole tubular string in a wellbore according to some embodiments of the present disclosure.
Figure 6:
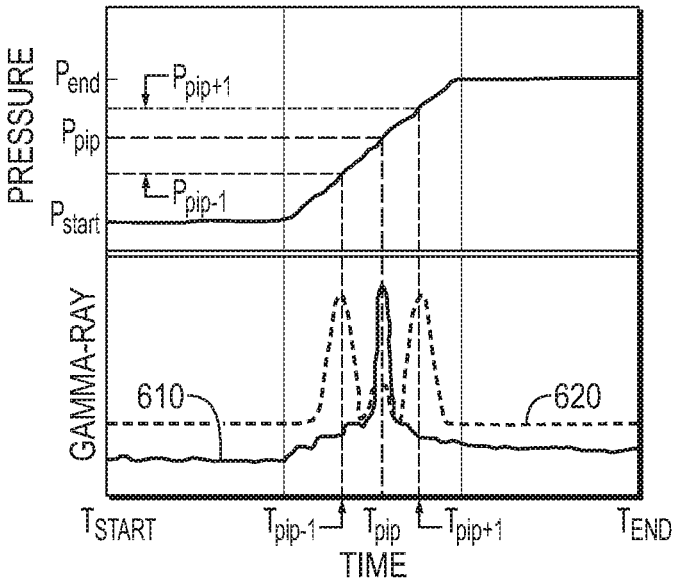
FIG. 6 illustrates a graph showing one possible wellbore property, pressure, and radiation intensity, a gamma-ray intensity, vs. time according to some embodiments of the present disclosure.
Figure 7A:
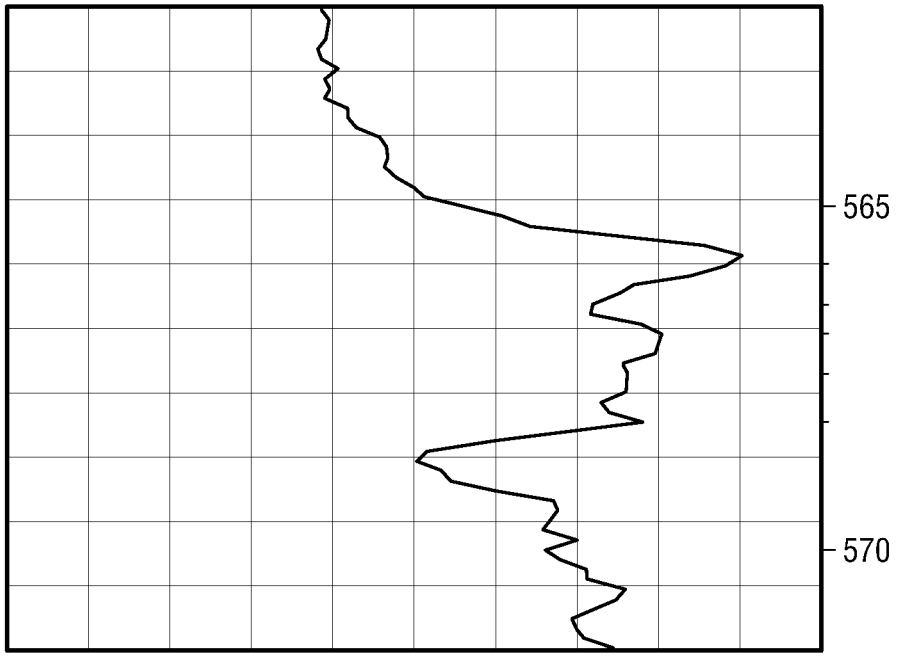
FIGS. 7A and 7B illustrate a wireline open-hole gamma-ray log which may be used according to some embodiments of the present disclosure
Figure 7B:
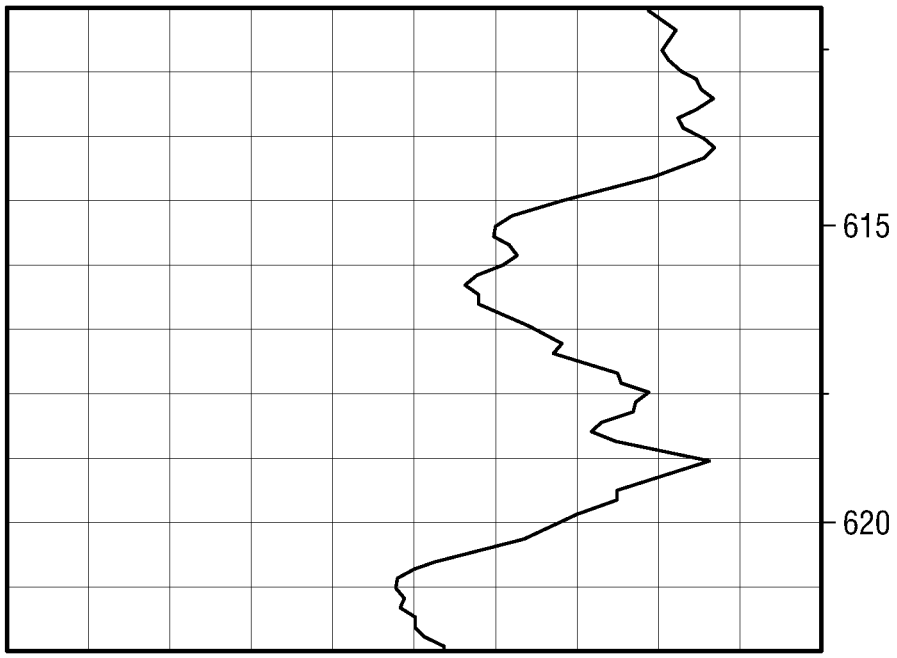

FIGS. 4A and 4B show a schematic view of a tubular string 315 in a wellbore 310 emanating radiation at at least one location along the wellbore 310. The radiation emanating from the wellbore 310 may be caused by a radioactive source 400 located along the wellbore 310. The radioactive source may be an artificial source of radiation, such as a radioactive pip-tag or a radiated activated casing, or a natural radioactive source, such as the natural background radiation emanating from the formation 311 in which the wellbore 310 is formed. FIG. 5 shows a flow diagram illustrating a method 500 of determining the position of a downhole tubular string in a wellbore according to some embodiments of the present disclosure. FIG. 6 illustrates a graph showing the tubular string length and gamma-ray intensity vs. time according to some embodiments of the present disclosure. FIGS. 7A and 7B illustrate a wireline open-hole gamma-ray log which may be used according to some embodiments of the present disclosure. Other gamma-ray logs may also be used including open-hole logs, cased-hole logs, logs performed by drilling & measurement operations, wireline operations, or any type of operation that my result in creation of log showing the degree of radiation emanating from the wellbore walls vs depth of or location along the wellbore. Determining the location of a tubular string or other downhole component in a wellbore 310 will now be discussed in relation to FIGS. 4A, 4B, 5, 6, 7A, and 7B.

Turning to FIGS. 4A and 4B, if the radioactive source 400 is an artificial source, such as a radioactive pip-tag, the artificial radioactive source may be placed in the casing during a casing cementing operation. The radioactive source 400 may be located at a generally known position according to the TD and SD, which position may be determined during a wireline cement logging operation typically performed during cementing operations of the wellbore. Radioactive pip-tags are generally formation markers placed into casing cement at pre-determined intervals along the wellbore 310 when the wellbore is cased. Some wellbores may have multiple radioactive sources 400 located along the wellbore wall, as shown in FIGS. 4A and 4B.

If the radioactive source 400 is a natural radioactive source, the natural background radiation, such as gamma-ray radiation, emanates from the formation 311 forming the wellbore 310 and through any casing and cement present. In the situations utilizing the natural radioactive source, the radioactive source 400 shown in the Figures depicts locations along the wellbore 310 that have higher intensities of background radiation. For example, FIGS. 7A and 7B show an open-hole gamma-ray log with sufficient variation to provide a radiation intensity signature, such as between 565 and 570 meters downhole in FIG. 7A and 615 and 620 meters downhole in FIG. 7B.

In some embodiments, the method includes placing a tubular string 315 into a wellbore 310 having at least one radioactive source 400, as shown in box 502. The tubular string 315 has at least one depth measurement module 120, as shown in box 502 and FIGS. 4A-4B. The depth measurement module 120 was previously described and shown in FIG. 2. In some embodiments, two or more depth measurement modules 120 may be provided along the tubular string 315. The depth measurement modules 120 are spaced apart along the tubular string 315 at known distances, which known distance can also be used to correlate the position of the depth measurement modules, and thus the location in the wellbore of various tools that are part of the tubular string 315.

A wellbore property that is a function of depth is determined, as shown in box 504. In some embodiments, a plurality of wellbore property measurements are obtained wherein at least one wellbore property is a function of depth. In one example, the plurality of wellbore property measurements may be obtained by measuring a wellbore property with the depth measurement module 120 at a plurality of locations in the wellbore 310. One of the locations in the wellbore 310 may be at the radioactive source 400. Generally, the plurality of locations where a measurement of a wellbore property is taken may include locations above the radioactive source 400, such as position A, at the radioactive source 400, such as position B, and below the radioactive source 400, such as position C. Measurements may be taken at multiple locations along the wellbore, either discretely or continuously. Wellbore property measurements may also be obtained during an RIH operation (where the tubular string is run in the hole) or a POOH operation (when the tubular string is pulled out of the hole).

The wellbore property that is measured is a function of depth. Some examples of downhole parameters or wellbore properties that are a function of depth may include pressure, temperature, density, gravity, and acceleration. For purposes of this discussion, pressure will be used as a specific example of wellbore properties that are a function of depth, although other wellbore properties that are a function of depth may be equally effective. The sensors 202 in depth measurement module 120 may include sensors for sensing the wellbore property, such as pressure or temperature sensors. The sensors 202 also include a radiation sensor for measuring the intensity of nearby radiation, in order to determine a plurality or radiation intensities, as shown in box 506, or obtain a plurality of radiation intensity measurements. The wellbore property and radiation intensity measurements taken along the wellbore as the tubular string is extended into or out of the wellbore may be correlated with each other and the total time used to obtain the measurements. One such correlation is shown in FIG. 6, which is described below in more detail.

Measuring the wellbore property with the depth measurement module 120 may include measuring the wellbore property at a first location A above the radioactive source 400, which first measurement may be termed $DP_{start}$. The wellbore property may also be measured at a second location B when the depth measurement module 120 is at the radioactive source 400 such as a pip-tag, which second measurement may be termed $DP_{pip}$. The wellbore property may also be measured at a third location C in the wellbore below the radioactive source 400, which third measurement may be termed $DP_{end}$. The radioactive source 400 may be located at a known distance $Z_0$ from the zone of interest 308.

If pressure is chosen as the wellbore property to be measured, the three different measurements in this example may be termed $P_{start}$, $P_{pip}$, $P_{end}$. Additionally, the wellbore property may be continuously measured as the depth measurement module 120 moves up and down the wellbore 310, such as shown in the graph illustrated in FIG. 6. Likewise, more than one wellbore property that is a function of depth may be measured at the same time using multiple types of sensors with the depth measurement module 120, such as pressure and temperature.

Determining the change in length of the tubular string 315 as it is extended or extracted from the wellbore in order to obtain the wellbore property that is a function of depth and the radiation intensity at at least one location is optional, as shown in dashed box 508. This change in length, which may be termed length change $L_\Delta$, is the change in tubular string length utilized to obtain the plurality of downhole measurements along the wellbore. The length change $L_\Delta$ of the tubular string 315 is the difference in tubular string lengths at various downhole measurement locations along the wellbore, such as the difference of the tubular string length at $DP_{start}$ and $DP_{end}$.

In one example, the length change, $L_\Delta$, is the length $L_{in}$ of the tubular string 315 that is introduced into the wellbore in order to measure the wellbore property at the plurality of locations. Determining the length $L_{in}$ may be performed in various ways. In one example, the length $L_{in}$ may be determined by measuring a first distance, $h_1$, from a rig floor 302 to a top of the tubular string 315 when the depth measurement module 120 is at the first location "A" in the wellbore 310. Another option is to measure the length $L_{out}$ that is extracted from the wellbore as the tubular string 315 is pulled out of the wellbore and wellbore property measurements are obtained during the pull out procedure. Any known methods of determining the length change LA, of the tubular string 315, whether it is $L_{in}$ or $L_{out}$, during the wellbore property measurements may be used.

After obtaining the first measurement such as pressure, $P_{start}$, one or more tubulars 410 of known length L may be connected to the tubular string 315 and the tubular string 315 may be lowered into the wellbore 310 to perform the second and third measurements $P_{pip}$ and $P_{end}$. The tubular 410 may be a single drill pipe, tubing section, or a stand, which stand is typically formed by connecting together three drill pipes or tubing sections prior to connecting the stand to the tubular string. Made-up stands may be stored on the drill rig site, ready for connecting to the drill string. After the wellbore property measurements are complete, a second distance, $h_2$, from the rig floor 302 to the top of the tubular string 315 is measured when the tubular string 315 is at the third location C.

Knowing the location or depth in the wellbore where each wellbore property measurement is taken can be determined by using a correlation between the radiation intensity, which intensity is determined and/or measured with the radiation sensor disposed in the depth measurement module 120 during measurement of the wellbore property at the plurality of locations, and the measured wellbore properties. FIG. 6 illustrates a graph of the measured wellbore property and radiation intensity vs time. In this example, the measured wellbore property is pressure and the radiation is gamma-ray type radiation. Two different measurements of radiation intensity are shown, line 610 illustrating measurement of a single radioactive source placed in the wellbore, and dashed line 620 illustrating measurement of a plurality of radioactive sources placed in the wellbore.

Beginning with line 610, at a time $t_{start}$, the pressure $P_{start}$ is measured at a first location A in the wellbore 310. The tubular string 315 is lowered into the wellbore 310. The pressure and gamma-ray intensity may be continuously or discontinuously (discreetly) measured as the tubular string is run in the hole (RIH). The gamma-ray intensity peaks at time $t_{pip}$ at the second location B when the depth measurement module 120 is at the same depth as the radioactive source 400, such as a pip-tag. The pressure at time $t_{pip}$ is measured, which corresponds to $P_{pip}$. The depth measurement module 120 passes by the radioactive pip-tag as the tubular string 315 continues to be lowered into the wellbore 310. Extension of the tubular string 315 into the wellbore 310 is stopped at time $t_{end}$, and the pressure at that location in the wellbore is measured, which corresponds to $P_{end}$. The wellbore property measurements and radiation intensity data from the radiation sensor may be transmitted via the telemetry device 208 up the tubular string 313 and to the wellbore surface system 58, as shown in FIG. 1.

Line 620 illustrates measurement of a plurality of radioactive sources that are placed in the wellbore at known locations. For example, three radioactive sources may be placed at set intervals a part from each other along the wellbore 310, such as one meter apart. The plurality of radioactive sources 400 then form a known pattern of measured radiation intensity, thereby providing a radiation intensity signature indicating that the depth measurement module is at a known location along the wellbore. The radioactive sources may have varying radiation intensities, giving a cluster of radiation measurement peaks that form the known pattern. For example, as shown in line 620, the middle radioactive source measured at time $t_{pip}$ may have lower radiation intensity than the neighboring radioactive sources, measured at times $t_{pip-1}$ and $t_{pip+1}$. Providing a radiation measurement signature may further decrease time for obtaining the desired location as the known pattern indicating the location signature may be quicker for operators to discern than radiation measurement patterns measured from a single radioactive source. Alternatively, if the natural background radiation is utilized, the known pattern of measured radiation intensity may be provided by the gamma-ray logs as shown in FIGS. 7A and 7B. The cluster of radiation peaks and valleys which provide sufficient variation, thereby forming a characteristic signature of radiation intensity.

Once the wellbore property and radiation intensity have been determined, the location of the depth measurement module 120 in the wellbore 310 may be determined based on a correlation of the wellbore property that is a function of depth and the radiation intensity at at least one location within the wellbore, as shown in box 510. Optionally, the length change $L_\Delta$ of the tubular string in the wellbore utilized in order to determine the wellbore property and radiation intensity at at least one location within the wellbore 310 may be included in the correlation between the wellbore property and the radiation intensity used to determine the location of the depth measurement module in the wellbore 310. In situations where more than one depth measurement module 120 is provided along the tubular string 315, the correlation may also include the radiation intensities and wellbore properties determined by the two measurement modules 120 and the known distance along the tublar string 315 between the two measurement modules.

The plurality of wellbore property measurements may include $P_{start}$, $P_{pip}$, $P_{end}$. The radiation intensity at those corresponding locations where the wellbore property measurements were obtained may include a continuous radiation intensity measurement as shown in FIG. 6. The length change $L_\Delta$ of the tubular string in the wellbore may include length $L_{in}$ of drill string 315 introduced into the wellbore 310. For example, determining a distance travelled by the tubular string 315 into the wellbore may be based on a correlation of $h_1$, $h_2$, L, and the measured wellbore properties at the first, second, and third locations, $DP_{start}$, $DP_{pip}$, $DP_{end}$.

Using pressure as an example, we can determine the depth and location of the depth measurement module 120 using the following equations. The total length of tubular string introduced may be calculated according to the following formula:

$$L_{in}=h_1+L-h_2$$

A rough idea of the density is known in the wellbore before a desired operation is performed, such as perforation. Therefore, an estimated value of the pressure can be calculated at any depth using the hydrostatic pressure law:

$$P=\rho\cdot g\cdot h$$

Once the total length $L_{in}$ is determined, the location or depth in the wellbore 310 of the depth measurement module 120 may be determined using the hydrostatic pressure law according to the following formula:

$$\Delta P=\rho_L\cdot g\cdot\cos\alpha\cdot\Delta z\rightarrow\rho_L\cdot\cos\alpha=\frac{\Delta P}{g\cdot\Delta z}=\frac{1}{g}\cdot\frac{P_{end}-P_{start}}{L_{in}} \quad \text{(Eq. 1)}$$

Thus:

$$z_1=\frac{P_{end}-P_{pip}}{\rho_L\cdot g_L\cdot\cos\alpha}=L_{in}\cdot\frac{P_{end}-P_{pip}}{P_{end}-P_{start}} \quad \text{(Eq. 2)}$$

$$\boxed{z_1=(h_1+L-h_2)\cdot\frac{P_{end}-P_{pip}}{P_{end}-P_{start}}}$$

where $Z_1$ is the depth of the depth measurement module 120 in the wellbore. For Eq. 2 to be effective, the density, gravity, and tubing deviation are assumed to be constant or nearly constant with an acceptable amount of error introduced.

The wellbore property measurements may also be taken in reverse order as well, such as at location C first, location B second, and location A last, such as may be done while obtaining wellbore property measurements while pulling the tubular string out of the wellbore.

When extracting the tubular string 315 from the wellbore 310, one or more tubulars 410 of known length L may be disconnected from the tubular string 315 after measuring a first distance, $h_1$, from a rig floor to a top of the tubular string when the depth measurement module is at location C in the wellbore below the pip-tag. A wellbore property at location C is measured, termed $DP_{start}$, using the depth measurement module. The tubular string 315 is then extracted from the wellbore 310, and the wellbore property is measured at a second location B when the depth measurement module 120 is at the radioactive pip-tag, $DP_{pip}$. The method also includes measuring the wellbore property at a third location A in the wellbore above the pip-tag, $DP_{end}$, and measuring a second distance, $h_2$, from the rig floor to the top of the tubular string when the tubular string is at the third location C. The method also includes determining the location of the depth measurement module in the wellbore based on a correlation of $h_1$, $h_2$, L, and the measured wellbore properties at the first, second, and third locations, $DP_{start}$, $DP_{pip}$, and $DP_{end}$.

By using embodiments of the present disclosure, the rate at which the tubing string is run into the hole does not need to be constant. Additionally, the depth location process may include multiple iterations where measuring the wellbore property at the plurality of locations and the determining the length, $L_{in}$, of the tubular string 310 introduced into the wellbore when performing the wellbore property measurements is repeated. Then, determining the location or depth of the depth measurement module 120 based on the repeated measuring and determining processes is performed again. Iterating the process for determining the location or depth of the module 120 may be particularly beneficial to increase accuracy. Moreover, the depth measurement module may be repositioned to a desired wellbore location based on its determined location. For example, if the location of the depth measurement module and hence the tubing string is determined to be in the incorrect desired location, but at a known incorrect location or depth, the tubing string may be raised or lowered by an amount calculated to place the depth measurement module and tubing string in the desired location based on its current incorrect location or depth.

Although some of the examples described herein review wellbore property measurements taken as the tubular string 315 is RIH, similar data could be collected and transmitted at multiple locations within the wellbore 310 and in various sequences, such as when the tubular string is pulled out of the hole (POOH).

Although the preceding description has been described herein with reference to particular means, materials and embodiments, it is not intended to be limited to the particulars disclosed herein; rather, it extends to all functionally equivalent structures, methods, and uses, such as are within the scope of the appended claims.

The invention claimed is:

1. A method, comprising:

placing a tubular string having at least a depth measurement module into a wellbore, the wellbore emanating radiation from a radioactive source location along the wellbore;

receiving, during a time period that the depth measurement module is within the wellbore, a radiation intensity measured by the depth measurement module at at least one location within the wellbore;

receiving a plurality of wellbore, property measurements of a wellbore property of the wellbore at a plurality of locations, wherein the plurality of wellbore property measurements are measured by the depth measurement module at the plurality of locations within the wellbore, wherein the wellbore property comprises at least one of a pressure, a temperature, a density, a gravity, or an acceleration measured by the depth measurement module, wherein the plurality of locations comprises a first location, a second location, and a third location each corresponding to different longitudinal positions along the wellbore with respect to the radioactive source, wherein the first location is above the radioactive source location, wherein the second location at the radioactive source location, and wherein the third location is below the radioactive source location;

measuring a first distance, $h_1$, from a rig floor to a top of the tubular string when the depth measurement module is at the first location in the wellbore;

receiving data indicating one or more tubulars of known length L that are connected to the tubular string;

lowering the tubular string into the wellbore;

measuring a second distance, $h_2$, from the rig floor to the top of the tubular string when the tubular string is at the third location;

determining a length change of the tubular string in the wellbore based on a correlation of $h_1$, $h_2$, L, and the plurality of wellbore property measurements at the first, second, and third locations;

determining a location of the depth measurement module in the wellbore based on the radiation intensity measured by the depth measurement module at the at least one location and the determined length change; and positioning a tool of the tubular string at a desired location within the wellbore based on the determined location of the depth measurement module.

2. The method of claim 1, wherein the radioactive source location is a known location in the wellbore.

3. The method of claim 2, wherein the wellbore has a plurality of known locations that emanate radiation and which form a known pattern of radiation intensity, thereby providing a radiation intensity signature along the wellbore.

4. The method of claim 1, wherein the radioactive source comprises an artificial radioactive source.

5. The method of claim 1, wherein the radioactive source comprises a natural radioactive source.

6. The method of claim 1, wherein the radioactive source comprises a pip-tag.

7. The method of claim 1, wherein the radioactive source is located along a casing of the wellbore.

8. The method of claim 7, wherein the radioactive source is mounted to the casing at a known location.

9. The method of claim 1, further comprising:

transmitting signals representing at least one of the radiation intensity and the plurality of wellbore property measurements from the depth measurement module to a wellbore surface system.

10. The method of claim 1, wherein the tubular string includes two or more depth measurement modules placed at a known distance apart from each other along the tubular string.

11. The method of claim 1, wherein the tool of the tubular string is a perforating gun, a packer, a valve, or a testing apparatus.

12. The method of claim 1, further comprising operating the tool of the tubular string at the desired location.

13. A method, comprising:

placing a tubular string having at least a depth measurement module into a wellbore, the wellbore emanating radiation from a radioactive source location along the wellbore;

receiving, during a time period that the depth measurement module is within the wellbore, a radiation intensity measured by the depth measurement module at at least one location within the wellbore;

receiving a plurality of wellbore property measurements indicating pressure of the wellbore at a plurality of locations, wherein the plurality of wellbore property measurements are measured by the depth measurement module at the plurality of locations within the wellbore, wherein the plurality of locations comprises a first location, a second location, and a third location each corresponding to different longitudinal positions along the wellbore with respect to the radioactive source, wherein the first location is above the radioactive source location, wherein the second location at the radioactive source location, and wherein the third location is below the radioactive source location;

measuring a first distance, $h_1$, from a rig floor to a top of the tubular string when the depth measurement module is at the first location in the wellbore;

receiving data indicating one or more tubulars of known length L that are connected to the tubular string;

lowering the tubular string into the wellbore;

measuring a second distance, $h_2$, from the rig floor to the top of the tubular string when the tubular string is at the third location;

determining a length change of the tubular string in the wellbore based on a correlation of $h_1$, $h_2$, L, and the plurality of wellbore property measurements at the first, second, and third locations;

determining a location of the depth measurement module in the wellbore based on the radiation intensity measured by the depth measurement module at the at least one location and the determined length change; and positioning a tool of the tubular string at a desired location within the wellbore based on the determined location of the depth measurement module.

* * * * *